US011332869B2

(12) United States Patent
Kwon et al.

(10) Patent No.: US 11,332,869 B2
(45) Date of Patent: May 17, 2022

(54) CLOTHES-PROCESSING APPARATUS

(71) Applicant: LG ELECTRONICS INC., Seoul (KR)

(72) Inventors: Sunku Kwon, Seoul (KR); Youngho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 156 days.

(21) Appl. No.: 15/569,614

(22) PCT Filed: Apr. 11, 2016

(86) PCT No.: PCT/KR2016/003756
§ 371 (c)(1),
(2) Date: Oct. 26, 2017

(87) PCT Pub. No.: WO2016/175477
PCT Pub. Date: Nov. 3, 2016

(65) Prior Publication Data

US 2018/0117645 A1 May 3, 2018

(30) Foreign Application Priority Data

Apr. 27, 2015 (KR) ..... 10-2015-0058982

(51) Int. Cl.
*D06F 35/00* (2006.01)
*B08B 9/093* (2006.01)
(Continued)

(52) U.S. Cl.
CPC ..... *D06F 35/008* (2013.01); *B08B 9/093* (2013.01); *D06F 37/12* (2013.01); *D06F 37/267* (2013.01); *D06F 39/088* (2013.01)

(58) Field of Classification Search
CPC ..... D06F 39/088; D06F 39/083; D06F 39/08; D06F 35/008; B08B 9/093
(Continued)

(56) References Cited

U.S. PATENT DOCUMENTS 2,526,344 A * 10/1950 Geldhof ..... D06F 39/06 68/148
2,611,256 A * 9/1952 Candor ..... D06F 39/08 68/12.14
(Continued)

FOREIGN PATENT DOCUMENTS

JP 05-253392 10/1993
KR 10-2010-0082932 7/2010
(Continued)

OTHER PUBLICATIONS

PCT International Search Report issued in Application PCT/KR2016/003756 dated Jul. 12, 2016 (26 pages).

*Primary Examiner* — Michael E Barr
*Assistant Examiner* — Thomas Bucci
(74) *Attorney, Agent, or Firm* — Birch, Stewart, Kolasch & Birch, LLP

(57) ABSTRACT

A clothes-processing apparatus is disclosed. The clothes-processing apparatus may have a cabinet defining an external appearance of the apparatus. The clothes-processing apparatus may also have a tub body provided inside the cabinet to accommodate water. Further, the clothes-processing apparatus may have a tub cover coupled to the tub body. The tub cover may have an opening through which laundry is introduced. The clothes-processing apparatus may have a drum rotatably provided inside the tub to accommodate laundry. The clothes-processing apparatus may also have a plurality of cleaning nozzles provided at the tub to spray the water toward a preset area of the drum. At least some of the
(Continued)

plurality of cleaning nozzles may jet water at different spray angles.

5 Claims, 3 Drawing Sheets

(51) Int. Cl.
*D06F 37/12* (2006.01)
*D06F 37/26* (2006.01)
*D06F 39/08* (2006.01)

(58) Field of Classification Search
USPC ..... 68/13 R, 207, 23.5, 17 R, 58, 139, 200, 68/5 C
See application file for complete search history.

(56) References Cited

U.S. PATENT DOCUMENTS 3,575,020 A * 4/1971 Hubbard ..... D06F 13/00 68/4
3,663,975 A * 5/1972 Fish ..... D06F 37/42 8/158
3,742,736 A * 7/1973 Fish ..... D06F 39/088 68/23.5
4,502,303 A * 3/1985 Wasemann ..... D06F 37/24 68/23.2
4,519,223 A * 5/1985 Wasemann ..... D06F 37/262 68/23.5
4,555,019 A * 11/1985 Spendel ..... D06F 35/006 206/223
4,809,524 A * 3/1989 Sickert ..... D06F 37/145 68/148
5,285,664 A * 2/1994 Chang ..... D06F 39/083 68/18 F
5,582,039 A * 12/1996 Mueller ..... D06F 39/083 68/17 R
5,590,552 A * 1/1997 Kim ..... D06F 39/088 68/207
5,657,650 A * 8/1997 Lee ..... D06F 39/083 68/23.5
5,768,730 A * 6/1998 Matsumoto ..... D06F 34/16 8/159
5,823,018 A * 10/1998 Lee ..... D06F 39/083 68/23.5
5,937,677 A * 8/1999 Lee ..... D06F 39/083 68/23.5
6,185,774 B1 * 2/2001 Tubman ..... D06F 39/083 8/158
6,351,974 B1 * 3/2002 Lyu ..... D06F 35/006 68/148
7,424,810 B2 * 9/2008 Zaccone ..... D06F 39/088 68/23.5
7,677,062 B2 * 3/2010 Zaccone ..... D06F 39/088 68/23.5
8,567,219 B2 * 10/2013 Choi ..... D06F 58/203 68/5 C
2005/0034488 A1 * 2/2005 Oh ..... D06F 39/083 68/5 C
2005/0060813 A1 * 3/2005 Patil ..... D06F 39/083 8/159
2005/0273945 A1 * 12/2005 Zaccone ..... D06F 39/088 8/159
2007/0107138 A1 * 5/2007 Bernardino ..... D06F 39/06 8/158
2007/0107471 A1 * 5/2007 Zaccone ..... D06F 39/088 68/3 R
2007/0295037 A1 * 12/2007 Blomberg ..... D06F 39/08 68/17 R
2009/0249838 A1 * 10/2009 Kim ..... D06F 39/088 68/58
2009/0249840 A1 * 10/2009 Jo ..... D06F 39/008 68/5 C
2010/0000266 A1 * 1/2010 Chung ..... D06F 23/04 68/205 R
2010/0205753 A1 * 8/2010 Kim ..... D06F 39/083 8/137
2010/0251784 A1 * 10/2010 Lee ..... D06F 39/088 68/200
2011/0088172 A1 * 4/2011 Im ..... D06F 21/00 8/137
2011/0100070 A1 * 5/2011 Kim ..... D06F 39/088 68/200
2012/0167639 A1 * 7/2012 Kikukawa ..... D06F 23/025 68/141
2014/0033449 A1 * 2/2014 Im ..... D06B 1/08 8/137
2014/0208810 A1 * 7/2014 Zattin ..... D06F 37/065 68/58
2014/0223969 A1 * 8/2014 Kim ..... D06F 37/225 68/12.06
2014/0299164 A1 * 10/2014 Zhang ..... D06F 35/008 134/34
2015/0114046 A1 * 4/2015 Jeong ..... D06F 39/088 68/17 R
2015/0121969 A1 * 5/2015 Lim ..... D06F 23/04 68/131
2015/0128657 A1 * 5/2015 Kim ..... D06F 39/088 68/132
2016/0115635 A1 * 4/2016 Lee ..... D06F 39/083 68/17 R

FOREIGN PATENT DOCUMENTS

KR 10-1176071 8/2012
KR 10-2013-0114970 10/2013
KR 10-1462860 11/2014

* cited by examiner

【FIG. 1】
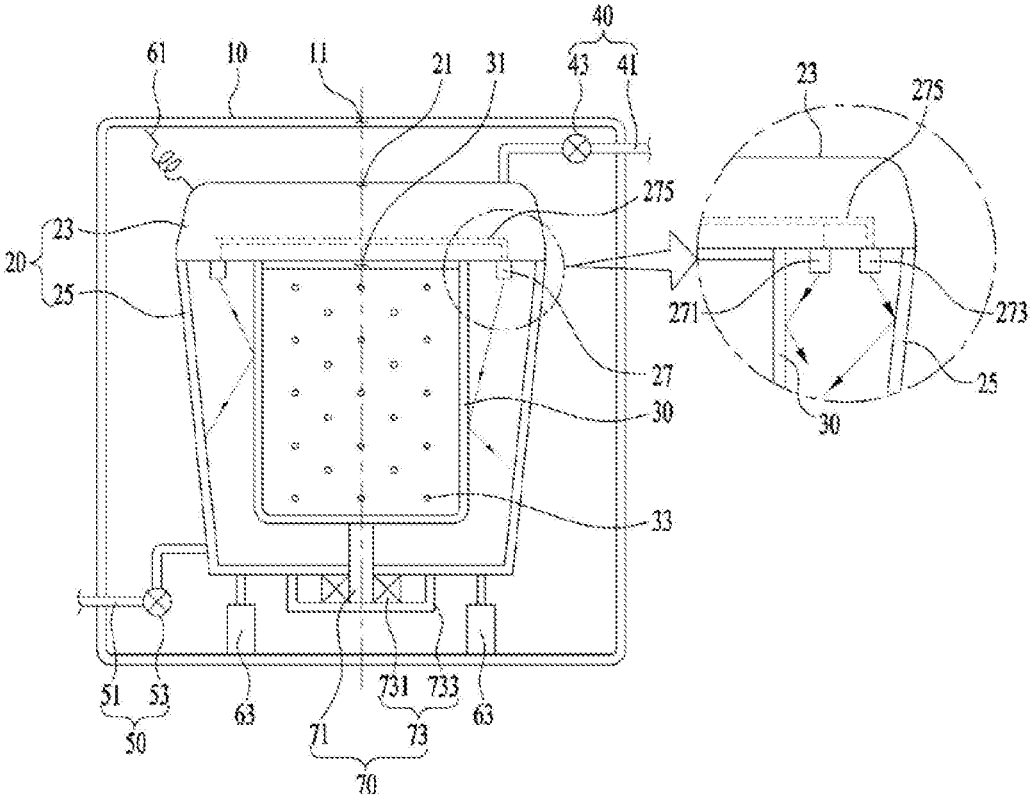

【FIG. 2】
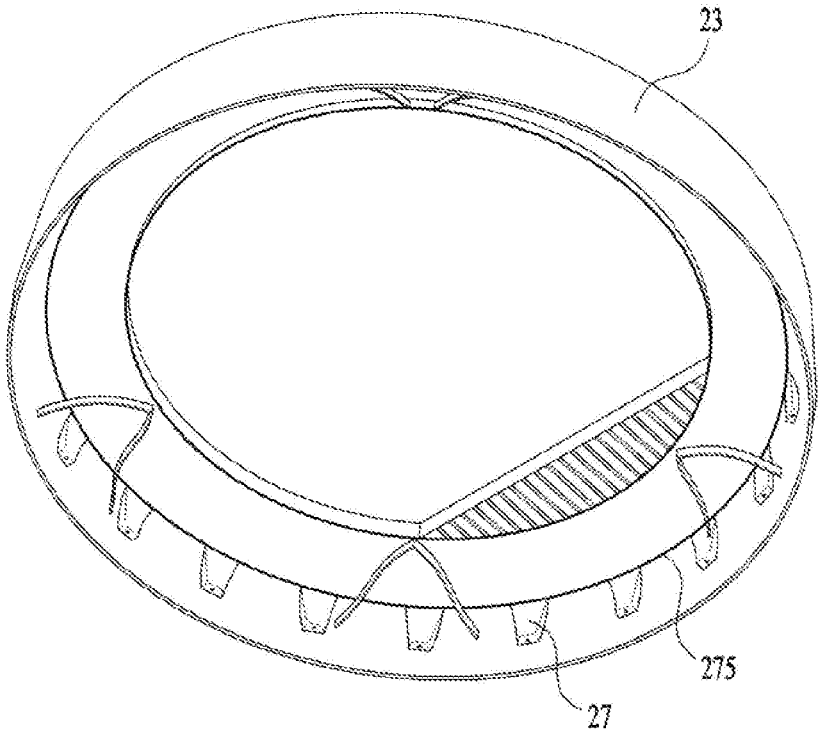

【FIG. 3】
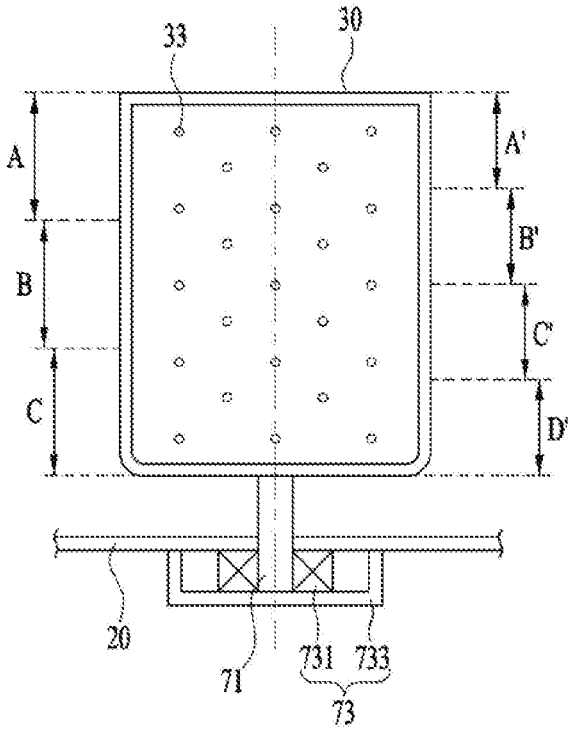
【FIG. 4】
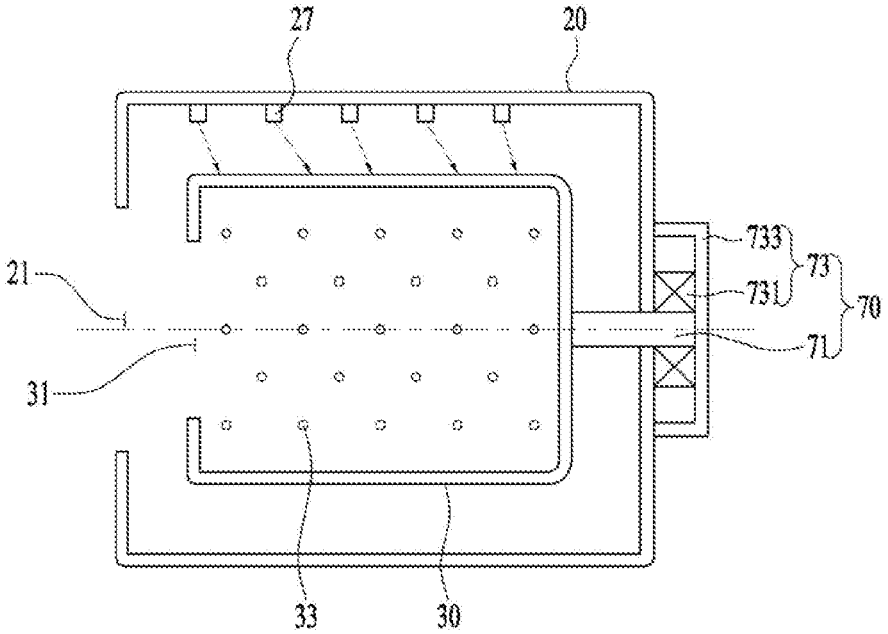

CLOTHES-PROCESSING APPARATUS

CLAIM FOR PRIORITY

This application is a U.S. National Phase entry under 35 U.S.C. § 371 from PCT International Application No. PCT/KR2016/003756, filed Apr. 11, 2016, which claims benefit of priority of Korean Patent Application No. 10-2015-0058982, filed Apr. 27, 2015, all of which are incorporated herein by reference.

TECHNICAL FIELD

The present invention relates to a clothes-processing apparatus.

BACKGROUND ART

A clothes-processing apparatus conceptually includes a washing apparatus that washes laundry and a drying apparatus that dries laundry washed in the washing apparatus.

When such a clothes-processing apparatus is used as the washing apparatus, the clothes-processing apparatus may include a cabinet, which defines the external appearance of the apparatus, a tub provided inside the cabinet to accommodate wash water therein, a drum rotatably provided inside the cabinet to accommodate laundry therein, and a door provided on one surface of the cabinet to enable the introduction or discharge of laundry.

In addition, when such a clothes-processing apparatus is used as the drying apparatus, the clothes-processing apparatus may include a cabinet, which defines the external appearance of the apparatus, a drum rotatably provided inside the cabinet to accommodate laundry therein, and a door provided on one surface of the cabinet to enable the introduction or discharge of laundry.

Generally, the clothes-processing apparatus may be divided into a top-loading type, in which the rotation axis of the drum is provided orthogonal to the ground, and a front-loading type, in which the rotation axis of the drum is provided parallel to the ground.

In a conventional clothes-processing apparatus, after wash water is supplied into the tub, the wash water supplied to the inside of the tub is supplied to the inside of the drum through holes provided in the circumferential surface of the drum for communication of the inside of the drum with the outside thereof.

Because the drum is provided so as to be rotatable in the state in which laundry is accommodated therein, foreign substances (hereinafter referred to as lint) generated from the laundry inside the drum may adhere to the circumferential surface of the drum.

However, because the conventional clothes-processing apparatus has no device for cleaning the circumferential surface of the drum, several problems occur, such as secondary contamination by the lint adhering to the circumferential surface of the drum.

In addition, in the case of the top-loading-type clothes-processing apparatus, contamination by the lint is more severe on the lower portion of the drum than on the upper portion of the drum.

In addition, in the case of the front-loading-type clothes-processing apparatus, contamination by the lint is more severe on the rear surface of the drum than on the front surface of the drum.

Technical Object

One object of the present invention is to provide a clothes-processing apparatus having a cleaning device that is capable of cleaning the circumferential surface of a drum.

In addition, another object of the present invention is to provide a top-loading-type clothes-processing apparatus having a cleaning device that may more intensively clean the lower portion of the drum than the upper portion of the drum.

In addition, another object of the present invention is to provide a front-loading-type clothes-processing apparatus having a cleaning device that may more intensively clean the rear surface of the drum than the front surface of the drum.

Technical Solution

To achieve the objects described above, in accordance with one aspect of the present invention, a clothes-processing apparatus includes a cabinet defining an external appearance of the apparatus, a tub provided inside the cabinet to accommodate wash water therein, a drum rotatably provided inside the tub to accommodate laundry therein, and a plurality of cleaning nozzles provided at the tub to spray the wash water toward a preset area of the drum.

In addition, the cleaning nozzles may be provided on an inner surface of a tub cover that is provided on an upper surface of the tub, and may be provided along a circumference that is spaced apart from a center of the tub cover by a predetermined distance.

In addition, the cleaning nozzles may include at least two cleaning nozzles having different wash water spray angles.

In addition, the drum may be provided so that a rotation axis thereof is orthogonal to a ground, the drum may include a first area that is an uppermost area among three areas, into which a side surface of the drum is divided depending on a height, a second area that is a lowermost area among the three areas, into which the side surface of the drum is divided depending on the height, and a third area provided between the first area and the second area, and a number of cleaning nozzles that spray the wash water toward the second area may be greater than a number of cleaning nozzles that spray the wash water toward the first area.

In addition, the number of cleaning nozzles that spray the wash water toward the second area may be greater than a number of cleaning nozzles that spray the wash water toward the third area.

In addition, the number of cleaning nozzles that spray the wash water toward the third area may be greater than the number of cleaning nozzles that spray the wash water toward the first area.

In addition, the drum may be provided so that a rotation axis thereof is parallel to a ground, the drum may include a first area that is a foremost area among three areas, into which a side surface of the drum is divided, a second area that is a hindmost area among the three areas, into which the side surface of the drum is divided, and a third area provided between the first area and the second area, and a number of cleaning nozzles that spray the wash water toward the second area may be greater than a number of cleaning nozzles that spray the wash water toward the first area.

In addition, the number of cleaning nozzles that spray the wash water toward the second area may be greater than a number of cleaning nozzles that spray the wash water toward the third area.

In addition, the number of cleaning nozzles that spray the wash water toward the third area may be greater than the number of cleaning nozzles that spray the wash water toward the first area.

In addition, the cleaning nozzles may be provided to have different distances from a center of the tub.

In addition, the cleaning nozzles may be provided along at least two concentric circles having different radii from the center of the tub.

Advantageous Effects

The present invention has the effect of providing a clothes-processing apparatus having a cleaning device that is capable of cleaning the circumferential surface of a drum.

In addition, the present invention has the effect of providing a top-loading-type clothes-processing apparatus having a cleaning device that may more intensively clean the lower portion of the drum than the upper portion of the drum.

In addition, the present invention has the effect of providing a front-loading-type clothes-processing apparatus having a cleaning device that may more intensively clean the rear surface of the drum than the front surface of the drum.

DESCRIPTION OF DRAWINGS

FIG. 1 illustrates a clothes-processing apparatus of the present invention.

FIG. 2 illustrates a tub cover of the clothes-processing apparatus of the present invention, which includes cleaning nozzles.

FIG. 3 illustrates a drum of a top-loading-type clothes-processing apparatus of the present invention.

FIG. 4 illustrates a drum of a front-loading-type clothes-processing apparatus of the present invention.

DETAILED DESCRIPTION

Hereinafter, the configuration of the present invention will be described in detail with reference to the accompanying drawings.

FIG. 1 illustrates a clothes-processing apparatus of the present invention.

Referring to FIG. 1, the clothes-processing apparatus of the present invention may include a cabinet 10 defining the external appearance of the apparatus, a tub 20 provided inside the cabinet 10 to accommodate wash water therein, and a drum 30 rotatably provided inside the tub 20 to accommodate laundry therein.

The cabinet 10 may include a cabinet opening 11 formed in one surface thereof to enable the introduction or discharge of laundry.

In addition, the tub 20 may include a tub opening 21 at a position corresponding to the cabinet opening 11, preferably, on the same vertical line.

In addition, the drum 30 may include a drum opening 31, in order to allow the laundry that has passed through the cabinet opening 11 and the tub opening 21 to be introduced into or discharged from the drum 30.

The clothes-processing apparatus may further include a water supply unit 40 provided to supply the wash water into the tub 20 and a drain unit 50 provided to drain the wash water supplied into the tub 20.

The water supply unit 40 may include a water supply hose 41, which provides a flow path along which the wash water moves from an external water source to the inside of the tub 20, and a water supply valve 43, which is provided to control the amount of wash water to be supplied from the water supply hose 41 to the tub 20.

In addition, the drain unit 50 may include a drain hose 51, which is connected to one surface of the tub 20 to communicate with the inside of the tub 20 so as to provide a flow path, along which the wash water supplied into the tub 20 moves to the outside of the clothes-processing apparatus, and a drain valve 53, which is provided to control the amount of wash water to be drained from the drain hose 51.

The drum 30 is rotatably provided, which may increase the efficiency with which the laundry accommodated inside the drum 30 is washed. The clothes-processing apparatus of the present invention may include a drive unit 70, which is provided to rotate the drum 30.

The drive unit 70 may include a shaft 71, which has one end provided to rotate integrally with the drum 30 and the other end provided to rotate integrally with a motor unit 73, which will be described below, so as to transmit rotational force to the drum 30, and the motor 73, which supplies the rotational force to the shaft 71 so as to rotate the drum 30.

The motor 73 may be a general BLDC that is used in the art to which the present invention belongs. More specifically, the motor 73 may include a stator 731, which generates a rotational magnetic field, and a rotor 733, which is rotatably provided on the outer circumferential surface of the stator 731 and has one end provided to rotate integrally with the shaft 71.

In order to prevent noise generated by vibration or collision between the tub 20 and the cabinet 10 when vibration generated due to the rotation of the drum 30 is transmitted to the tub 20, causing the tub 20 to move relative to the cabinet 10, the clothes-processing apparatus of the present invention may further include a vibration unit 60.

The vibration unit 60 may include a first vibrator 61, which is provided as an elastic member, and a second vibrator 63, which is provided as a damper member.

In the drawings, although the first vibrator 61 is provided on the upper surface of the tub 20 and the second vibrator 63 is provided on the lower surface of the tub 20, this is illustrated in a simplified manner in order to clearly describe the function of the vibration unit 60. Therefore, the number of first vibrators 61 and the number of second vibrators 63 or the positions at which the first vibrators 61 and the second vibrators 63 are provided may be changed according to user need, and are not limited to the above description.

The tub 20 may include a tub body 25, which defines the external appearance of the tub 20 so as to accommodate laundry therein, and a tub cover 23, which is separably provided on the upper surface of the tub body 25. The tub body 25 may include a cleaning nozzle 27, which is provided on the inner surface of the tub cover 23 so as to spray wash water toward the outer circumferential surface of the drum 30, and a nozzle water-supply flow path 275, which is provided to supply wash water to the cleaning nozzle 27.

The cleaning nozzle 27 may be provided in a plural number and may be disposed along a circumference, which is spaced apart from the center of the tub cover 23 by a predetermined distance.

More specifically, a plurality of cleaning nozzles may be provided on the circumference so as to spray wash water toward the outer circumferential surface of the drum 30.

In addition, the cleaning nozzle 27 may include a first nozzle 271, which is provided on a circumference having a radius equal to a first distance from the center of the tub cover 23 in the radial direction, and a second nozzle 273, which is provided on a circumference having a radius equal to a second distance from the center of the tub cover 23 in the radial direction, the second distance being greater than the first distance.

Although the cleaning nozzle 27 of the present embodiment has been described as including the first nozzle 271 and the second nozzle 273, which are provided respectively along two concentric circles having different radii, the present embodiment is not limited thereto, and the nozzles may be disposed along three or more circles according to user need.

For convenience, the following description is based on the case where the cleaning nozzles 27 are provided along one circumference.

The multiple cleaning nozzles 27 may be provided along one circumference, and the respective cleaning nozzles 27 may have different wash water spray angles.

Although the cleaning nozzles 27 are located in the same plane as will be described below, respective nozzle spray holes (not illustrated) provided in the cleaning nozzles 27 may be provided to face different directions.

That is, the cleaning nozzles 27 may directly spray wash water toward the outer circumferential surface of the drum 30, or may spray wash water toward the inner circumferential surface of the tub 20 as needed. In this case, the wash water bouncing off of the inner circumferential surface of the tub 20 may wash the outer circumferential surface of the drum 30.

FIG. 2 illustrates the tub cover of the clothes-processing apparatus of the present invention, which includes the cleaning nozzles.

Referring to FIG, 2, the tub cover 23 is separably provided on the tub 20. That is, the tub cover 23 may have a plurality of fixing portions (not illustrated) for fixing the tub cover 23 to the tub 20.

The nozzle water-supply flow path 275 may be provided inside the tub cover 23 and may have a hollow shape, in order to supply wash water to the cleaning nozzles 27.

The wash water supplied by the nozzle water-supply flow path 275 having a hollow shape moves to the cleaning nozzles 27, which are spaced apart from one another by a predetermined distance in the circumferential direction, thereby being sprayed toward the outer circumferential surface of the drum 20.

Although not illustrated in the drawings, the nozzle water-supply flow path 275 may receive wash water supplied from the water supply unit 40.

Alternatively, the nozzle water-supply flow path 275 may receive wash water supplied from a separate water source, other than the water supply unit 40, and may supply the wash water to the cleaning nozzles 27.

In other words, the wash water supplied to the nozzle water-supply flow path 275 may be supplied from the water supply unit 40, or may be supplied from a separate external water supply unit (not illustrated), which is independent of the water supply unit 40.

The cleaning nozzles 27 may be provided between the inner circumferential surface of the tub body 25 and the outer circumferential surface of the drum 30.

Structurally, the drum 30 is rotatably provided inside the tub 20 and the tub cover 23 is provided on the upper surface of the tub 20. Here, the cleaning nozzles 27 protrude downward from the lower surface of the tub cover 23, and therefore are at risk of coming into contact with the drum 30 or the tub 20. Thus, when the cleaning nozzles 27 are disposed between the outer circumferential surface of the drum 30 and the inner circumferential surface of the tub 20, it is possible to avoid interference between the cleaning nozzles 27 and the drum 30 or the tub 20.

In addition, when the cleaning nozzles 27 are disposed between the outer circumferential surface of the drum 30 and the inner circumferential surface of the tub 20, the effect of causing the sprayed wash water to directly hit the outer circumferential surface of the drum 30 may be acquired. Specifically, when the wash water sprayed from the cleaning nozzles 27 does not directly hit the drum 30, the wash water sprayed from the cleaning nozzles 27 may primarily hit the inner circumferential surface of the tub 20, and then the water that bounces therefrom may secondarily hit the outer circumferential surface of the drum 30.

FIG. 3 illustrates a drum of a top-loading-type clothes-processing apparatus of the present invention.

Referring to FIG. 3, in the case of the top-loading-type clothes-processing apparatus in which the rotation axis of the drum 30 is provided orthogonal to the ground, the drive unit 70, which provides power required to rotate the drum 30, may be provided below the drum 30.

As described above, the drive unit 70 may include the shaft 71, which is provided so as to rotate integrally with the drum 30, and the motor 73, which supplies rotational force to the shaft 71.

Because the motor 73 may have the same structure as a general BLDC motor, a detailed description thereof will be omitted.

In the case of the top-loading-type clothes-processing apparatus, the side surface of the drum 30 may show a greater degree of contamination with lint with increasing distance from the top thereof.

Accordingly, when the cleaning nozzles 27 are used to wash the outer circumferential surface of the drum 30, the cleaning nozzles 27 may be provided so as to spray wash water at the same rate to the entire outer circumferential surface of the drum 30, but may be provided so as to spray wash water at an increasing flow rate with decreasing distance to the bottom of the drum 30.

In an embodiment, as illustrated in FIG. 3, when the outer side surface of the drum 30 is divided into three areas, the amount of wash water to be sprayed toward the lowermost area C may be greater than the amount of wash water to be sprayed toward the other areas A and B.

More specifically, the outer side surface of the drum 30 may be divided into three areas A, B and C.

A first area A may be the uppermost area among the three areas divided on the outer side surface of the drum 30, a second area C may be the lowermost area among the three areas divided on the outer surface of the drum 30, and a third area 13 may be provided between the first area A and the second area C.

As described above, the multiple cleaning nozzles 27 may be provided and may spray wash water at different spray angles toward the outer circumferential surface of the drum 30. In this case, the number of cleaning nozzles 27, which spray wash water toward the second area C, may be greater than the number of cleaning nozzles 27, which spray wash water toward the first area A.

In addition, the number of cleaning nozzles 27, which spray wash water toward the second area C, may be greater than the number of cleaning nozzles 27, which spray wash water toward the third area B.

In addition, the number of cleaning nozzles 27, which spray wash water toward the third area. B, may be greater than the number of cleaning nozzles 27, which spray wash water toward the first area A.

In other words, the number of cleaning nozzles 27, which spray wash water toward a specific area of the outer side surface of the drum 30, may be gradually increased with decreasing distance to the bottom of the drum 30.

In another embodiment, as illustrated in FIG. 3, when the outer side surface of the drum 30 is divided into four areas A', B', C' and D', the amount of wash water to be sprayed toward the lowermost area D' may be greater than the amount of wash water to be sprayed toward the other areas A', B' and C'.

More specifically, the outer side surface of the drum 30 may he divided into four areas A', B', C' and D'.

As described above, the amount of wash water to be sprayed may be increased in a given direction from the top to the bottom, i.e. from the area A' to the area D'.

In FIG. 3, although an embodiment is illustrated in which the outer side surface of the drum 30 is divided into three or four areas so that the wash water is sprayed to the respective areas, the number of areas into which the outer side surface of the drum 30 is divided may be changed according to user need as long as the amount of wash water to be sprayed is increased with decreasing distance to the bottom of the drum 30.

FIG. 4 illustrates a drum of a front-loading-type clothes-processing apparatus of the present invention.

Referring to FIG. 4, in the case of the front-loading-type clothes-processing apparatus in which the rotation axis of the drum 30 is provided parallel to the ground, the drive unit 70, which provides power required to rotate the drum 30, may be provided behind the drum 30.

As described above, the drive unit 70 may include the shaft 71, which is provided so as to rotate integrally with the drum 30, and the motor 73, which supplies rotational force to the shaft 71.

Because the motor 73 may have the same structure as a general BLDC motor, a detailed description thereof will be omitted.

In the case of the front-loading-type clothes-processing apparatus, the side surface of the drum 30 may show a greater degree of contamination with lint with increasing distance from the front side of the drum or decreasing distance to the rear side of the drum. Here, the front side of the drum 30 refers to the direction in which the drum opening 31 is formed, and the rear side of the drum 30 refers to the direction to which the drive unit 70 is coupled.

Accordingly, when the cleaning nozzles 27 are used to wash the outer circumferential surface of the drum 30, the cleaning nozzles 27 may be provided so as to spray wash water at the same rate to the entire outer circumferential surface of the drum 30, but may be provided so as to spray wash water at an increasing flow rate with decreasing distance to the rear side of the drum 30.

To this end, as illustrated in FIG. 3, when the outer circumferential surface of the drum 30 is divided into multiple areas, the number of cleaning nozzles 27, which spray wash water toward the rear side of the drum 30, may be greater than the number of cleaning nozzles 27, which spray wash water toward the front side of the drum 30.

A configuration in which the outer circumferential surface of the drum 30 is divided into multiple areas and wash water is sprayed at different densities to the respective areas may be applied in the same manner as the above description with reference to FIG. 3, and thus a repeated description thereof will be omitted.

The above detailed description is provided to illustrate the present invention. In addition, the above description has described the exemplary embodiments of the present invention, and the present invention may be used in various other combinations, modifications and environments. That is, the present invention may be altered or modified within the conceptual range of the present invention disclosed herein, within the range that is equivalent to the above-described disclosure, and/or within the range of technology or knowledge of the art to which the present invention belongs. The above embodiments have described the best mode to realize the technical idea of the present invention, and may be altered in various way to fulfill various requirements in the concrete applications of the present invention. Thus, the detailed description of the present invention is not intended to limit the present invention to the disclosed embodiments. In addition, the accompanying claims should be construed as including other embodiments.

What is claimed is:

1. A clothes processing apparatus, comprising:
- a cabinet;
- a tub comprising:
  - a tub body provided inside the cabinet and configured to accommodate water therein; and
  - a tub cover coupled to the tub body;
- a drum rotatably provided inside the tub and configured to accommodate laundry therein;
- a driving unit including a rotating shaft for rotating the drum through the tub body; and
- a plurality of cleaning nozzles provided on the tub cover, wherein the plurality of cleaning nozzles includes
  - first cleaning nozzles configured to spray water towards an outer wall of the drum, and
  - second cleaning nozzles provided closer to the tub body than the first cleaning nozzles and configured to spray water toward an inner wall of the tub body.

2. The clothes-processing apparatus according to claim 1, wherein the plurality of cleaning nozzles are configured to spray water at different spray angles towards the outer wall of the drum and the inner wall of the tub body.

3. The clothes-processing apparatus according to claim 1, wherein the plurality of cleaning nozzles are provided along a circumference of the tub cover.

4. The clothes-processing apparatus according to claim 1, wherein
- a top of the drum includes an opening, a bottom of the drum is coupled to the rotating shaft, and the outer wall of the drum has a midpoint between the top and the bottom of the drum, and
- the first cleaning nozzles are provided to spray more water toward a portion of the outer wall between the midpoint and the bottom of the drum as compared to a portion of the outer wall between the top of the drum and the midpoint.

5. The clothes-processing apparatus according to claim 1, wherein the first and second cleaning nozzles are provided to have different distances from a center of the tub.

* * * * *